United States Patent [19]

Schindel

[11] 4,309,820

[45] Jan. 12, 1982

[54] APPARATUS FOR INSERTING A CLOSURE WITH A FEEDPIPE INTO A CONTAINER

[75] Inventor: Hugo Schindel, Saulheim, Fed. Rep. of Germany

[73] Assignee: Rationator-Maschinenbau GmbH, Hillesheim, Fed. Rep. of Germany

[21] Appl. No.: 102,749

[22] Filed: Dec. 12, 1979

[30] Foreign Application Priority Data

Jan. 8, 1979 [DE] Fed. Rep. of Germany ..... 2900432

[51] Int. Cl.[3] ..... B23P 21/00

[52] U.S. Cl. ..... 29/785; 29/786; 140/147; 10/155 A

[58] Field of Search ..... 10/155 R, 155 A; 29/429, 785, 786, 792, 793, 794, 809; 113/1 E, 114 BC, 114 BF, 115; 72/92, 94; 140/147

[56] References Cited

U.S. PATENT DOCUMENTS

| | | | |
|---|---|---|---|
| 2,333,940 | 11/1943 | Kuehlman | 10/155 A |
| 2,642,593 | 6/1953 | Poupitch | 10/155 A |
| 2,914,781 | 12/1959 | Prutton | 10/155 A |
| 3,024,523 | 3/1962 | Donaldson | 29/785 X |
| 3,054,170 | 9/1962 | Benichasa et al. | 29/794 X |
| 3,225,370 | 12/1965 | Pipes | 10/155 A |
| 3,226,744 | 1/1966 | Marechal et al. | 10/155 A |
| 3,745,599 | 7/1973 | Ringland | 10/155 A |

*Primary Examiner*—Ervin M. Combs
*Attorney, Agent, or Firm*—Kurt Kelman

[57] ABSTRACT

An apparatus for inserting a closure with a feedpipe into a container comprises a drum arranged for rotation and having a circumferential wall defining outwardly open recesses for holding the closures with feedpipes, and a guide sheet fixedly mounted adjacent the circumferential wall and covering a portion thereof. The guide sheet has two end edges extending in the planes of the end faces of the drum and two oblique side edges downwardly inclined in the direction of rotation of the drum.

4 Claims, 3 Drawing Figures

7
4
3
17
8
9
14
5
11
2
10
13
1
6

APPARATUS FOR INSERTING A CLOSURE WITH A FEEDPIPE INTO A CONTAINER

The present invention relates to an apparatus for inserting a closure with a feedpipe, such as a standpipe or a hose, into a container.

The automatic insertion of such closures, which usually include a valve, is very difficult because the feedpipes, which may have a length of up to about 300 mm, are bent during the operation and must first be straightened before the closures can be inserted serially into the containers. Known machines of this type include means for gripping the closure at the upper end and means for aligning the feedpipe below the closure. Gripping tongues are then used to insert the thus aligned part into a bottle or like container. Such machines require expensive mechanisms and many movable parts, thus increasing maintenance costs. In addition, they have the disadvantage that each type of closure requires different holding and alignining means, which must be replaced for each operation. If these machines are found to be too expensive, the insertion must be effected by hand.

It is the primary object of this invention to provide an apparatus for the automatic insertion of closures with feedpipes in an assembly-line operation, which is structurally simple and adapted for use with various sizes of closures and valves with standpipes or hoses of different lengths.

The above and other objects are accomplished according to the invention with an apparatus which comprises a drum arranged for rotation in an operating direction, the drum having a circumferentially extending wall defining circumferentially spaced and outwardly open recesses for holding respective ones of the closures with a feedpipe, and two end faces. A guide sheet is fixedly mounted adjacent the circumferentially extending drum wall and covers a portion of the wall, the guide sheet having two end edges extending substantially in the planes defined by the two end faces and two oblique side edges downwardly inclined in the operating direction.

This apparatus has the advantage that various sizes of closures and valves with various lengths of standpipes or hoses may be handled with a single feed drum, this rotating drum constituting the sole moving part of the apparatus. The simplicity of this apparatus makes it very inexpensive. The closures with their feedpipes are automatically inserted seriatim and continuously as the containers are fed below the drum and the drum is rotated. This prevents any liquid from spilling out of the containers if they are filled to the brim.

Figure 1:
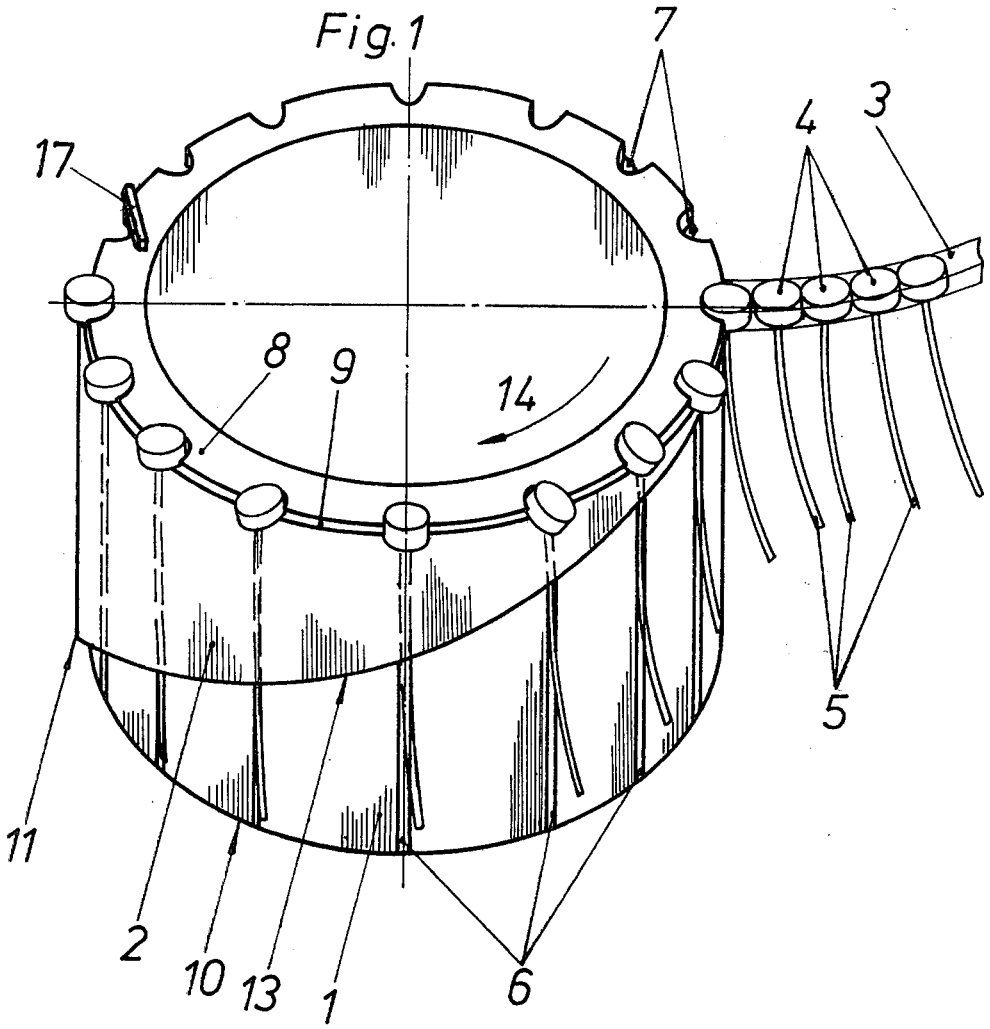
Figure 2:
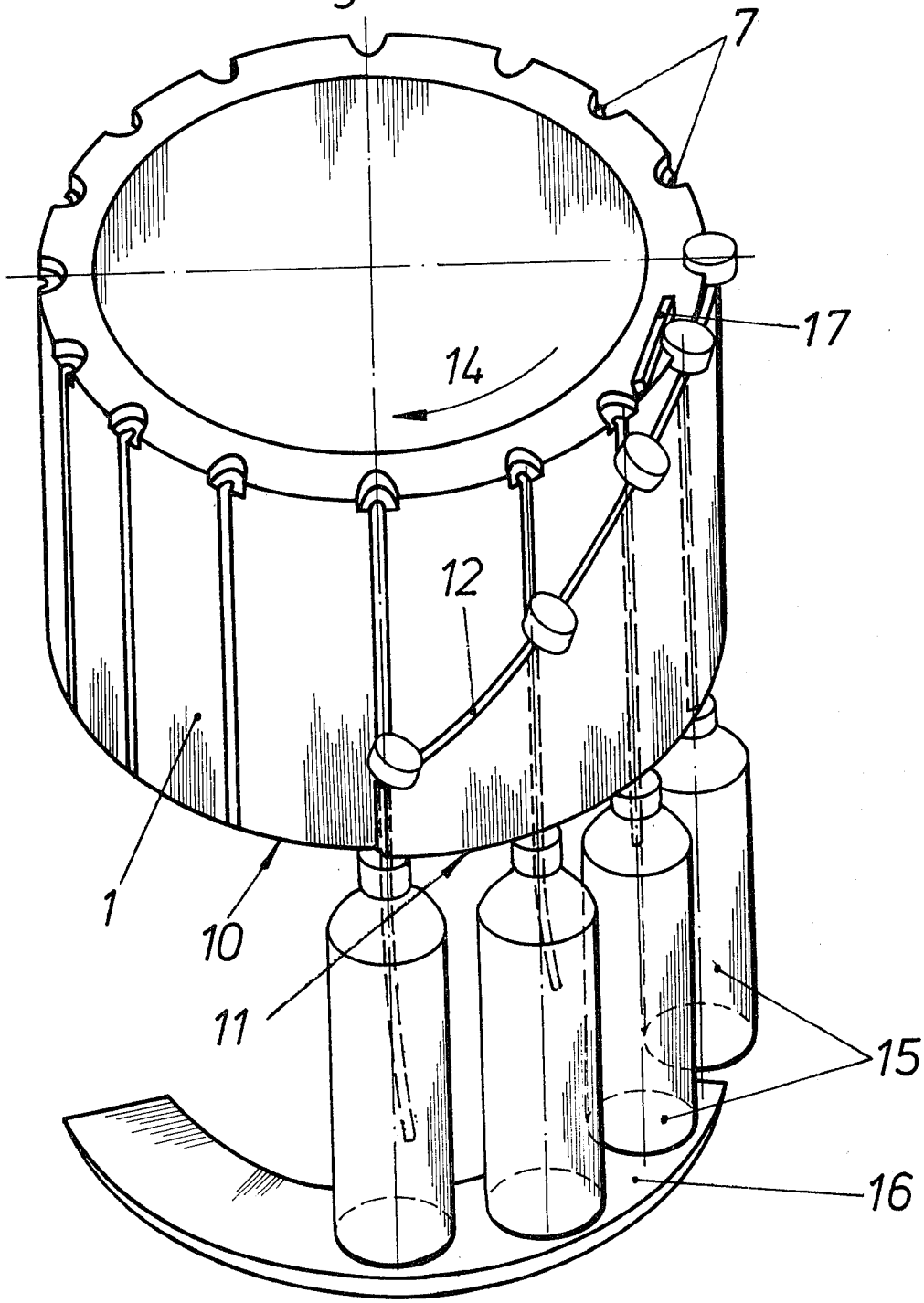
Figure 3:
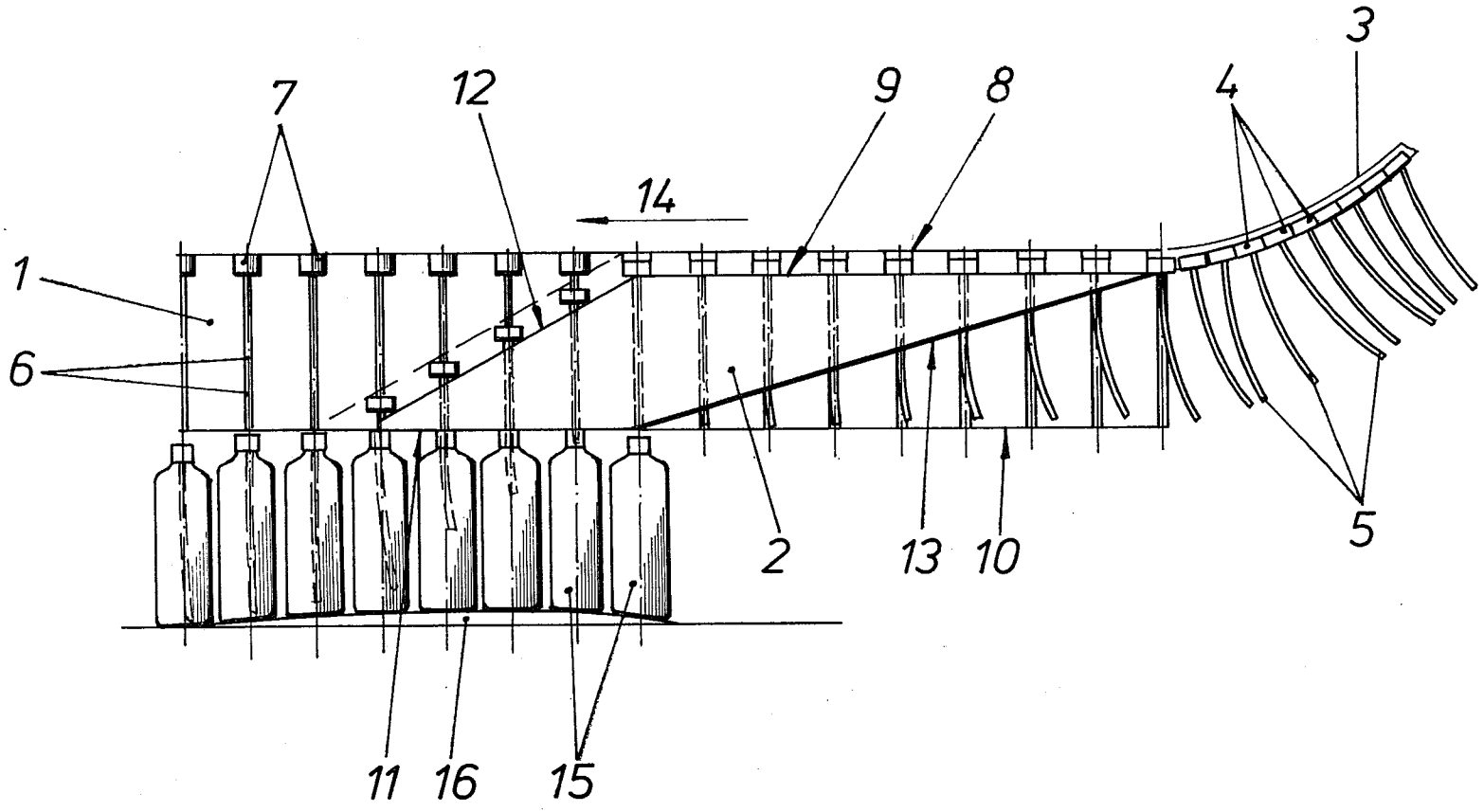

The above and other objects, advantages and features of the present invention will be more fully understood from the following detailed description of a now preferred embodiment thereof, taken in conjunction with the somewhat schematic drawing wherein FIG. 1 is a perspective view of the apparatus, showing the closures with their feedpipes being delivered thereto;

FIG. 2 is a like view showing the insertion of the closures into containers mounted therebelow; and FIG. 3 is a developed side view of the rotating drum and fixed guide sheet, illustrating the entire automatic inserting operation.

Referring now to the drawing, there is shown cylindrical drum 1 arranged for rotation in an operating direction indicated by arrow 14. The drum has a circumferentially extending wall and two end faces 8 and 10. The wall defines circumferentially spaced and outwardly open recesses for holding respective ones of closures 4 with feedpipe 5. In the preferred embodiment illustrated herein, the open recesses comprise vertically extending narrow groove 6 for holding feedpipe 5 and recess portion 7 at upper end face 8 for holding closure 4. Guide sheet 2, which may be a sheet metal element, is fixedly mounted adjacent, and slightly spaced from, the circumferentially extending drum wall and covers a portion of the wall, as best shown in FIG. 3. Guide sheet 2 has two end edges 9 and 11 extending substantially in the planes defined by end faces 8 and 10, and two oblique side edges 12 and 13 downwardly inclined in the operating direction indicated by arrow 14.

As illustrated in FIG. 1, a simple feeding device 3, such as a chute, sequentially delivers a succession of closures 4 with feedpipes 5 to drum 1 where they are received and held in circumferentially uniformly spaced recesses 6, 7. As will be seen in FIGS. 2 and 3, upper end edge 9 and trailing side edge 13 of guide sheet 2 reach to the point where the closures with their feedpipes are delivered to the drum so that, as the drum rotates in the direction of arrow 14, the closures and feedpipes will be held in their receiving recesses by the guide sheet while, as shown in FIG. 3, the feedpipes are simultaneously straightened out.

At the same time, a suitable conveyor sequentially delivers a succession of containers 15 in substantially alignment with cylindrical drum 1 and therebelow, a first one of the containers being delivered no later than at the leading end of lower edge 11 of guide sheet 2 below a respective groove 6. The insertion of feedpipe 5 into the neck of the container will be facilitated by wedge-shaped ramp 16 mounted in the path of the successive containers below guide sheet 2 for raising containers 15 in relation to drum 1. As shown, wedge-shaped ramp 16 is mounted below lower end edge 11 of the guide sheet. The insertion is further facilitated by ejecting finger 17 mounted at a point of transition from upper end edge 9 to leading side edge 12 of guide sheet 2.

The operation proceeds as follows:

As closures 4 with feedpipe 5 are sequentially fed into respective recesses 6, 7 and drum 1 is rotated in the direction of arrow 14, closures 4 will be held by upper edge 9 of guide sheet 2 while feedpipes 5 are moved progressively into grooves 6 by oblique trailing side edge 13 of the guide sheet until the feedpipes are completely straightened. At this point, i.e. at the lower end of oblique side edge 13, the closure with its straight feedpipe can be inserted into a container 15 aligned therewith, the containers being delivered at a spacing corresponding to that of grooves 6 and at the same speed as the rotary speed of drum 1. As the drum continues to rotate, closures 4 will descend along oblique leading edge 12, as best shown in FIGS. 2 and 3. Ejecting fingers 17 presses closures 4 out of recess portions 7.

What is claimed is:

1. An apparatus for inserting a closure with a flexible feedpipe into a container, which comprises (a) a drum arranged for rotation in an operating direction, the drum having (1) a circumferentially extending wall defining circumferentially spaced and outwardly open vertically extending narrow grooves for holding respective ones of the pipes, and (2) two end faces, each one of the narrow grooves having a recessed portion at an upper one of the end faces for holding the closure of the respective feedpipe, and (b) a guide sheet fixedly mounted adjacent the circumferentially extending drum wall and covering a portion of the wall, the guide sheet having (1) two end edges extending substantially in the planes defined by the two end faces and (2) two oblique side edges downwardly inclined in said operating direction, the guide sheet causing successive ones of the feedpipes held in the grooves to be straightened in the grooves during rotation of the drum, an upper one of the guide sheet end edges supporting the closures in the recessed portion while the successive feedpipes are straightened and a leading one of the oblique guide sheet side edges supporting the closures while the straightened feedpipes are moved along a downward path in said grooves for insertion in successive ones of the containers.

2. The apparatus of claim 1, further comprising an ejecting finger mounted at a point of the drum where the upper end edge and the leading side edge of the guide sheet meet.

3. The apparatus of claim 1, further comprising a wedge-shaped ramp mounted below the guide sheet for raising the containers in relation to the drum.

4. The apparatus of claim 3, wherein the wedge-shaped ramp is mounted below a lower one of the end edges of the guide sheet.

* * * * *